US006836177B2

(12) United States Patent
Ito

(10) Patent No.: US 6,836,177 B2
(45) Date of Patent: Dec. 28, 2004

(54) STEP-UP CIRCUITS

(75) Inventor: Satoru Ito, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/342,108

(22) Filed: Jan. 13, 2003

(65) Prior Publication Data

US 2003/0146782 A1 Aug. 7, 2003

(30) Foreign Application Priority Data

Jan. 17, 2002 (JP) ..... 2002-008373

(51) Int. Cl.[7] ..... G05F 1/10; G05F 3/02
(52) U.S. Cl. ..... 327/536
(58) Field of Search ..... 327/536, 589; 363/59–60

(56) References Cited

U.S. PATENT DOCUMENTS 6,100,752 A * 8/2000 Lee et al.
6,469,569 B1 * 10/2002 Miyamitsu
6,693,483 B2 * 2/2004 Deml et al. ..... 327/536

* cited by examiner

*Primary Examiner*—Quan Tra
(74) *Attorney, Agent, or Firm*—Hogan & Hartson, LLP

(57) ABSTRACT

A step-up circuit is equipped with a step-up clock signal generation device that generates a clock signal to be used for stepping up voltage, a plurality of step-up stages for successively stepping up a power supply voltage based on the clock signal, and control devices that controls, after starting an operation, the stepped up clock signal generated by the step-up clock signal generation device to be supplied to the plurality of step-up stages at different timings.

6 Claims, 9 Drawing Sheets

STEP-UP CIRCUITS

BACKGROUND OF THE INVENTION

The present invention generally relates to step-up circuits, and more particularly, step-up circuits that perform a charge pump operation.

To drive an LCD panel, for example, a voltage of 12–18V may be required when the duty is 1/100. However, since the power supply voltage of recent Integrated Circuits ("ICs") is a DC voltage of 1.8–3.6V, the power supply voltage must be stepped up by a step-up circuit to drive a LCD panel with such voltages.

FIG. 9(*a*) shows a state in which a step-up circuit is not operating. As indicated in FIG. 9(*b*), when clock signals V1–V4 are supplied to gates of transistors Q1–Q4, respectively, the step-up circuit starts its operation, and steps up a voltage between a first power supply potential $V_{DD}$ and a second power supply potential $V_{SS}$ to output an output potential $V_{OUT}$.

In FIG. 9(*b*), the transistors Q2 and Q4 are turned on, a current flows in a direction indicated by an arrow, and a charge is supplied to a flying capacitor C1. In this instance, the power supply potential $V_{DD}$ drops momentarily. If the same power supply potential $V_{DD}$ is also used in other circuits that are sensitive to changes in the power supply potential, these circuits may possibly malfunction. Furthermore, when a plurality of step-up circuits like the one indicated in FIGS. 9(*a*) and 9(*b*) are used, a change in the power supply potential $V_{DD}$ tends to become greater.

Accordingly, there is a need for step-up circuits that can reduce and/or possibly eliminate changes in the power supply potential upon starting a step-up circuit.

SUMMARY

A step-up circuit in accordance with a first aspect of the present invention is equipped with a step-up clock signal generation device that generates a clock signal to be used for voltage step-up, a plurality of step-up stages for successively stepping up a power supply voltage based on the clock signal, and a control device that controls, after starting an operation, the clock signal generated by the step-up clock signal generation device to be supplied to the plurality of step-up stages at different timings.

In some embodiments, the step-up clock signal generation device may generate a clock signal to be used for voltage step-up based on a clock signal applied, and the control device may include a counter that counts the clock signal applied to the step-up clock signal generation circuit, and a plurality of output control circuits that respectively supply, based on different output values of the counter, the clock signal generated by the step-up clock signal generation circuit to the plurality of step-up stages.

Alternatively, in other embodiments, the control device may include a counter that counts pulse signals applied, and a plurality of output control circuits that respectively supply, based on different output values of the counter, the clock signal generated by the step-up clock signal generation circuit to the plurality of step-up stages.

A step-up circuit in accordance with a second aspect of the present invention may be equipped with a step-up clock signal generation circuit that generates a clock signal to be used for voltage step-up, a plurality of step-up stages that successively step up a power supply voltage based on the clock signal, and a control device that, after a start of operation, activates the plurality of step-up stages at different timings.

In some embodiments, the step-up clock signal generation device may generate a clock signal to be used for voltage step-up based on a clock signal applied. The control device may include a counter that counts the clock signal applied to the step-up clock signal generation circuit. The plurality of output stages can be activated based on different output values of the counter.

Alternatively, the control device may include a counter that counts pulse signals applied. The plurality of step-up stages can be activated based on different output values of the counter.

A step-up circuit in accordance with a third aspect of the present invention is equipped with a step-up clock signal generation device that generates a clock signal to be used for voltage step-up, at least one step-up stage that steps up a power supply voltage based on the clock signal, and a control device that, after starting an operation, changes a frequency of the clock signal to be supplied to the step-up stage from a value lower than a normal value to the normal value.

In some embodiments, the control device may include a plurality of frequency-divider circuits that frequency-divide the clock signal generated by the step-up clock signal generation device, and respectively output a plurality of frequency-divided clock signals having different frequency division ratios, a selector circuit that selects, based on a control signal, one of the clock signal and the plurality of frequency-divided clock signals, and a counter that counts the clock signal selected by the selector circuit to thereby generate the control signal. The step-up stage may step up the power supply voltage based on the clock signal selected by the selector circuit.

Alternatively, the control device may include a plurality of frequency-divider circuits that frequency-divide a clock signal applied, and respectively output a plurality of frequency-divided clock signals having different frequency division ratios, a selector circuit that selects, based on a control signal, one of the clock signal and the plurality of frequency-divided clock signals, and a counter that counts the clock signal selected by the selector circuit to thereby generate the control signal. The step-up clock signal generation circuit may generate, based on the clock signal selected by the selector circuit, a clock signal to be used for voltage step-up.

In other embodiments, the control device may include a plurality of frequency-divider circuits that frequency-divide a clock signal applied, and respectively output a plurality of frequency-divided clock signals having different frequency division ratios, a counter that counts pulse signals applied, and a selector circuit that selects, based on an output value of the counter, one of the clock signal and the plurality of frequency-divided clock signals, and the step-up clock signal generation circuit may generate, based on the clock signal selected by the selector circuit, a clock signal to be used for voltage step-up.

In accordance with the first aspect of the present invention, after an operation is started, the clock signals generated by the step-up clock signal generation device are supplied to a plurality of step-up stages at different timings, such that changes in the power supply potential can be reduced at the time of starting an operation of the step-up circuit.

Also, in accordance with the second aspect of the present invention, after an operation is started, a plurality of step-up stages are activated at different timings, such that changes in the power supply potential can be reduced at the time of starting an operation of the step-up circuit.

Furthermore, in accordance with the third aspect of the present invention, after an operation is started, the frequency of a clock signal to be supplied to a plurality of step-up stages is changed from a value lower than a normal value to the normal value, such that changes in the power supply potential can be reduced at the time of starting an operation of the step-up circuit.

BRIEF DESCRIPTION OF DRAWINGS

The following discussion may be best understood with reference to the various views of the drawings, described in summary below, which form a part of this disclosure.

DETAILED DESCRIPTION OF THE PREFERRED EMBODIMENTS

Figure 1:
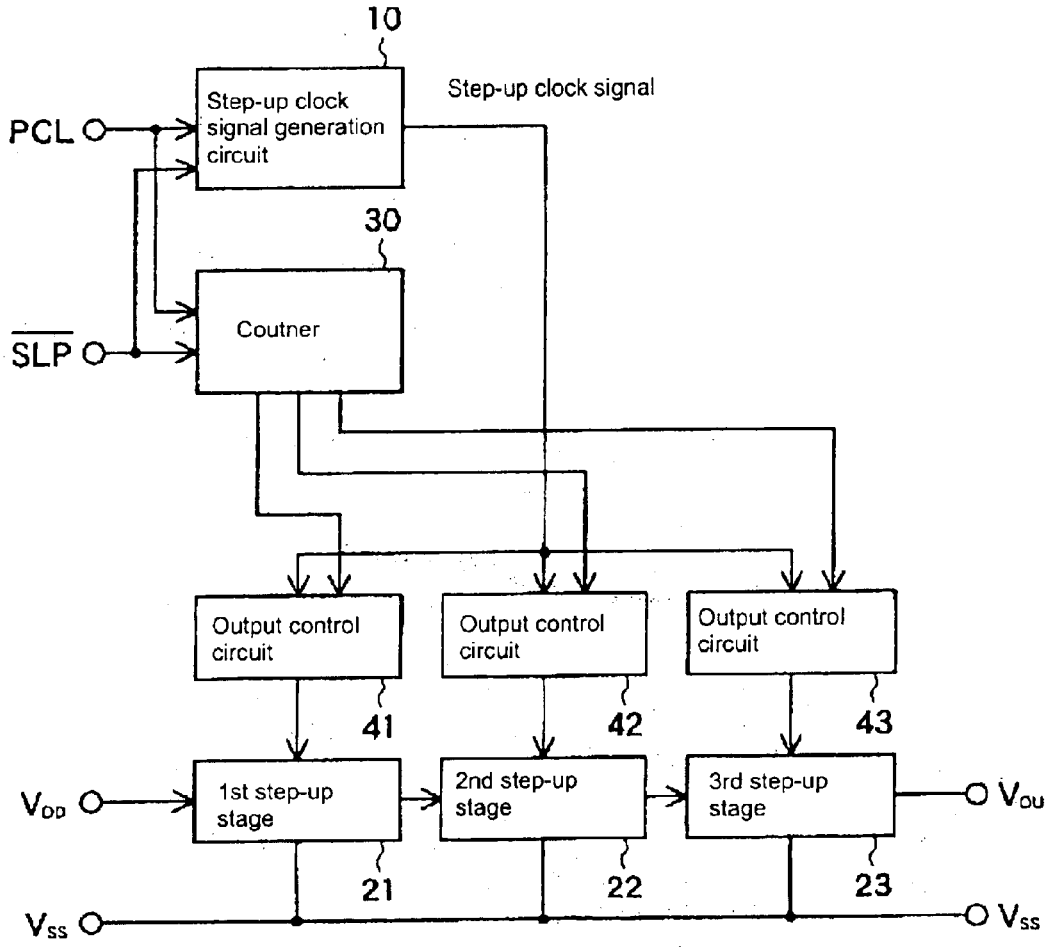
FIG. 1 shows a block diagram of a structure of a step-up circuit in accordance with a first embodiment of the present invention.

The present invention now will be described more fully with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the size of functional units are exaggerated for clarity. Like numbers refer to like elements throughout.

It will be understood that when an element such as a circuit, portion of a circuit, logic unit or line is referred to as being "connected to" another element, it can be directly connected to the other element or intervening elements may also be present. In contrast, when an element is referred to as being "directly connected to" another element, there are no intervening elements present. When an element such as a circuit, portion of a circuit, logic unit or line is referred to as being "adjacent" another element, it can be near the other element but not necessarily independent of the other element. When an element such as a circuit, portion of a circuit, logic unit or line is referred to as being "between" two things, it can be either partly of completely between those two things, but is not necessarily completely and continuously between those two things. The term "adapted to" should be construed to mean "capable of".

Figure 9:
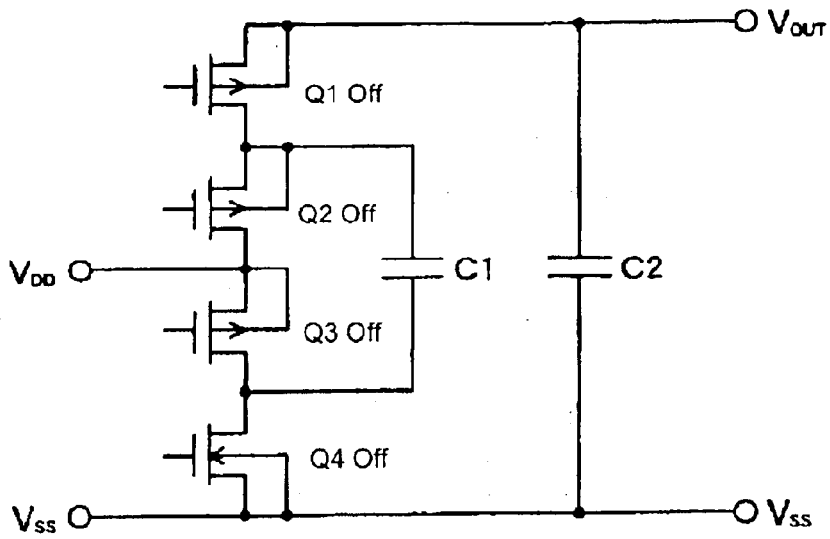
FIG. 9 shows a circuit diagram of an example of a structure of an ordinary step-up circuit for one stage.
Figure 9:
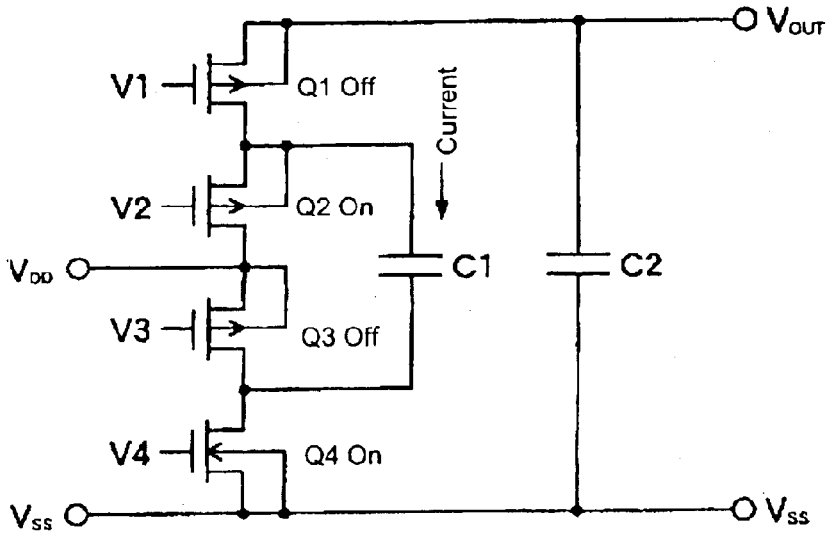

FIG. 1 shows a block diagram of a structure of a step-up circuit. As indicated in FIG. 1, the step-up circuit includes a step-up clock signal generation circuit 10 that generates a clock signal to be used for stepping up voltage (which may also be referred to below as a "step-up clock signal") based on a power clock signal PCL supplied, and a plurality of step-up stages (which indicate first—third step-up stages 21–23 in FIG. 1) that successively step up voltages between a first power supply voltage $V_{DD}$ and a second power supply voltage $V_{SS}$ (which is a ground potential in the present embodiment) based on the step-up clock signal generated by the step-up clock signal generation circuit 19 and output an output potential $V_{OUT}$. Each of the step-up stages has a structure shown in FIG. 9, for example.

Further, the step-up circuit includes a counter 30 that counts the supplied power clock signal PCL, and a plurality of output control circuits 41–43 that supply the step-up clock signal generated by the step-up clock signal generation circuit 10 to the corresponding plural step-up stages 21–23, respectively, based on different output values provided by the counter 30.

The power clock signal PCL may have, for example, a frequency of 7.2 kHz when each one frame of an image signal that drives an LCD panel is at 60 Hz and its duty is 1/120. The counter 30 counts the power clock signal PCL, and outputs output values (for example, $2^0$, $2^1$, $2^2$, $2^3$, . . . ) according to the counted numbers. Each of the plural output control circuits 41–43 supplies the step-up clock signal generated by the step-up clock signal generation circuit to each of the corresponding step-up stages, respectively, for example, when a specified output value of the counter 30 becomes a high level.

Figure 2:
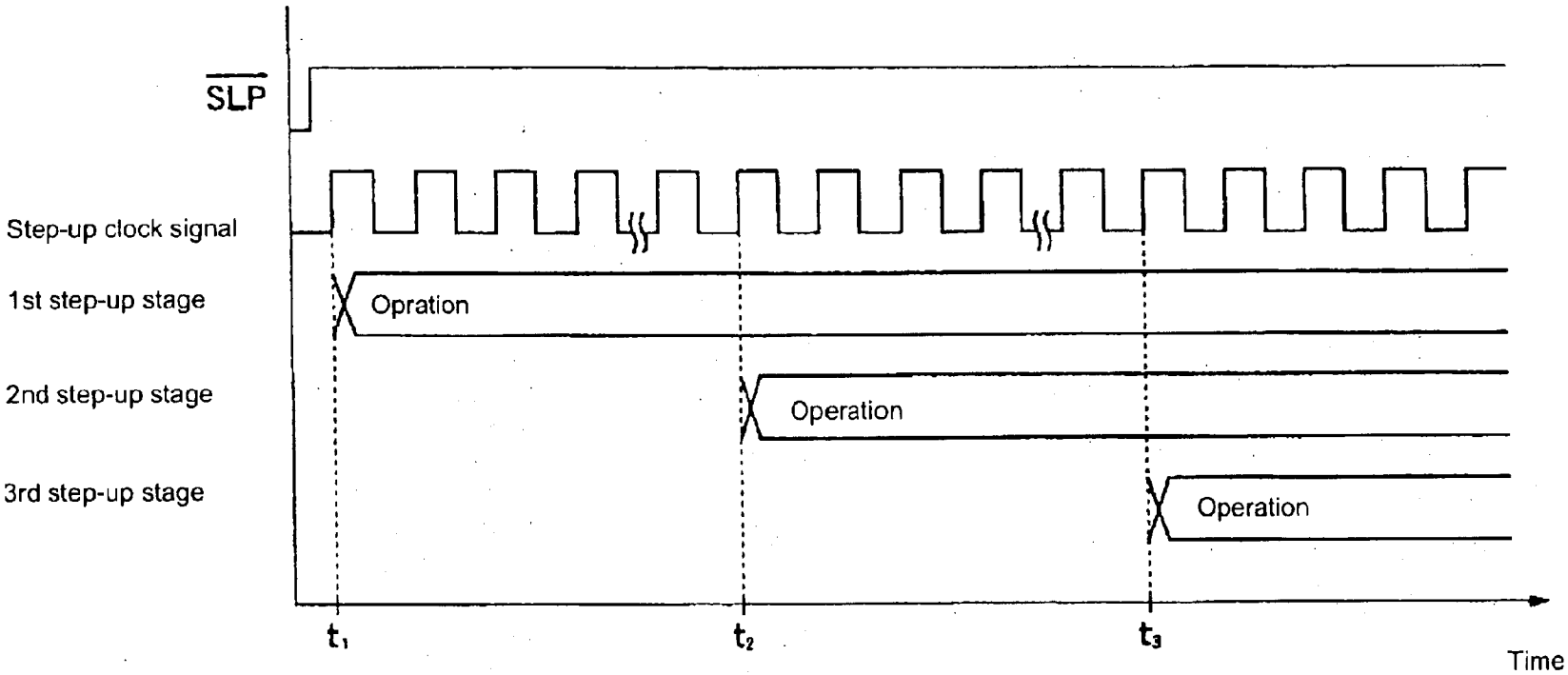
FIG. 2 shows a timing chart of operation timings of the step-up circuit in accordance with embodiments of the present invention.

Next, operations of the step-up circuit of the present embodiment will be described with reference to FIGS. 1 and 2. FIG. 2 shows a timing chart of operation timings of the step-up circuit in FIG. 1.

As indicated in FIG. 2, a sleep mode is released at time $t_1$, and an inverted sleep mode signal SLP bar becomes a high level. In association with this change, the supply of the power clock signal PCL is started. The step-up clock signal generation circuit 10 generates a step-up clock signal based on the power clock signal PCL, and the counter 30 counts the step-up clock signal.

When the output value of the counter 30 becomes a first value (for example, $2^0$=1), the output control circuit 41 starts supplying the step-up clock signal, and the first step-up stage 21 starts a step-up operation based on the step-up clock signal. At time $t_2$, when the output value of the counter 30 becomes a second value (for example, $2^5$=32), the output control circuit 42 starts supplying the step-up clock signal, and the second step-up stage 22 starts a step-up operation based on the step-up clock signal. At time $t_3$, when the output value of the counter 30 becomes a third value (for example, $2^6$=64), the output control circuit 43 starts supplying the step-up clock signal, and the third step-up stage 23 starts a step-up operation based on the step-up clock signal. At a moment when the counter 30 outputs a third value, the counting of the step-up clock signal begins.

Thereafter, a sleep mode is set again, and when an inverted sleep mode signal SLP bar becomes a low level, the output value of the counter 30 is reset. In the present embodiment, the counter 30 counts the power clock signal PCL. However, it is noted that the counter 30 may count scanning start pulses in a vertical direction that are used for a liquid crystal display or the like.

In this manner, when the step-up circuit starts its operation, the timings to supply step-up clock signals to the multiple step-up stages 21–23 are shifted such that the step-up stages are operated successively stage by stage. As a result, changes in the power supply voltage can be suppressed. In the present embodiment, since the power supply potential $V_{SS}$ is a ground potential, a drop of the power supply potential $V_{DD}$ is suppressed.

Figure 3:
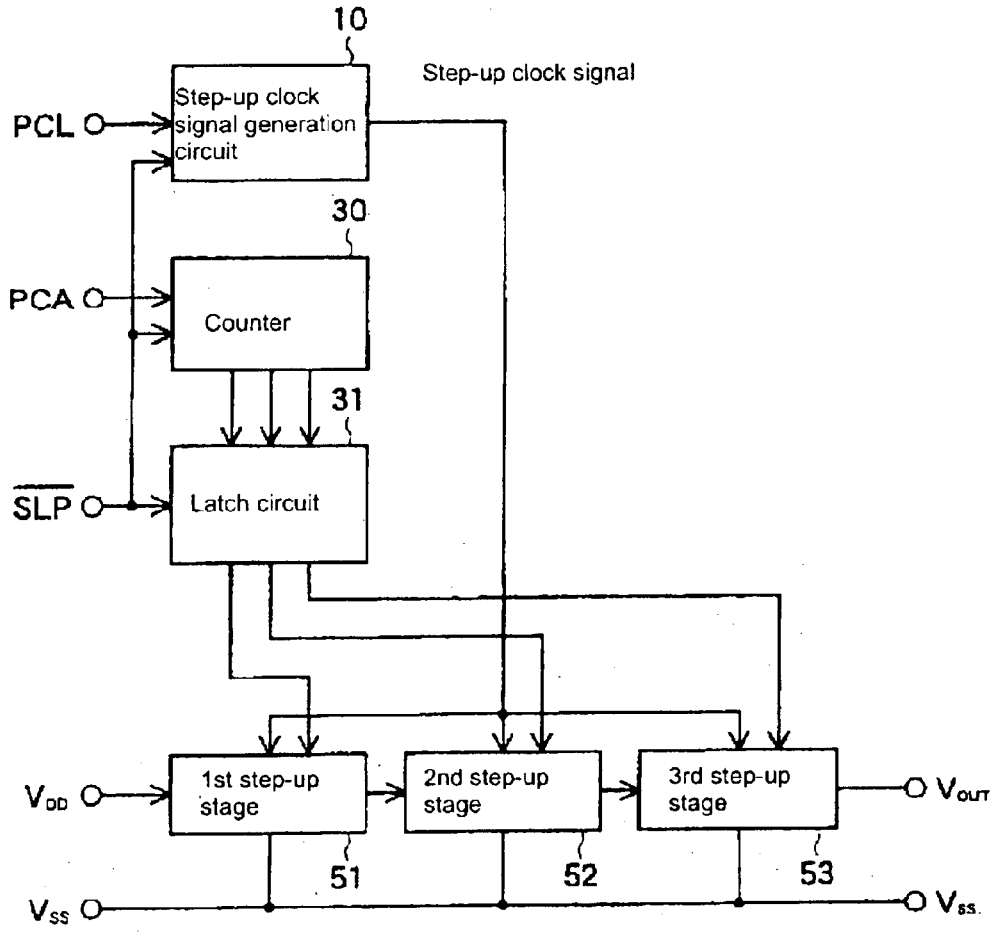
FIG. 3 shows a block diagram of a structure of a step-up circuit in accordance with other embodiments of the present invention.

FIG. 3 shows a block diagram of a structure of another embodiment of the step-up circuit. In the present embodiment, a counter 30 counts scanning start pulses PCA in a vertical direction that may be used for a liquid crystal display or the like. Also, a latch circuit 31 is provided to latch output values of the counter 30, and output signals of the latch circuit 31 are used as enable signals for first-third step-up stages 51–53. The first—third step-up stages 51–53 operate only when the enable signal is at a high level. Other aspects are the same as those of the embodiment discussed above.

Figure 4:
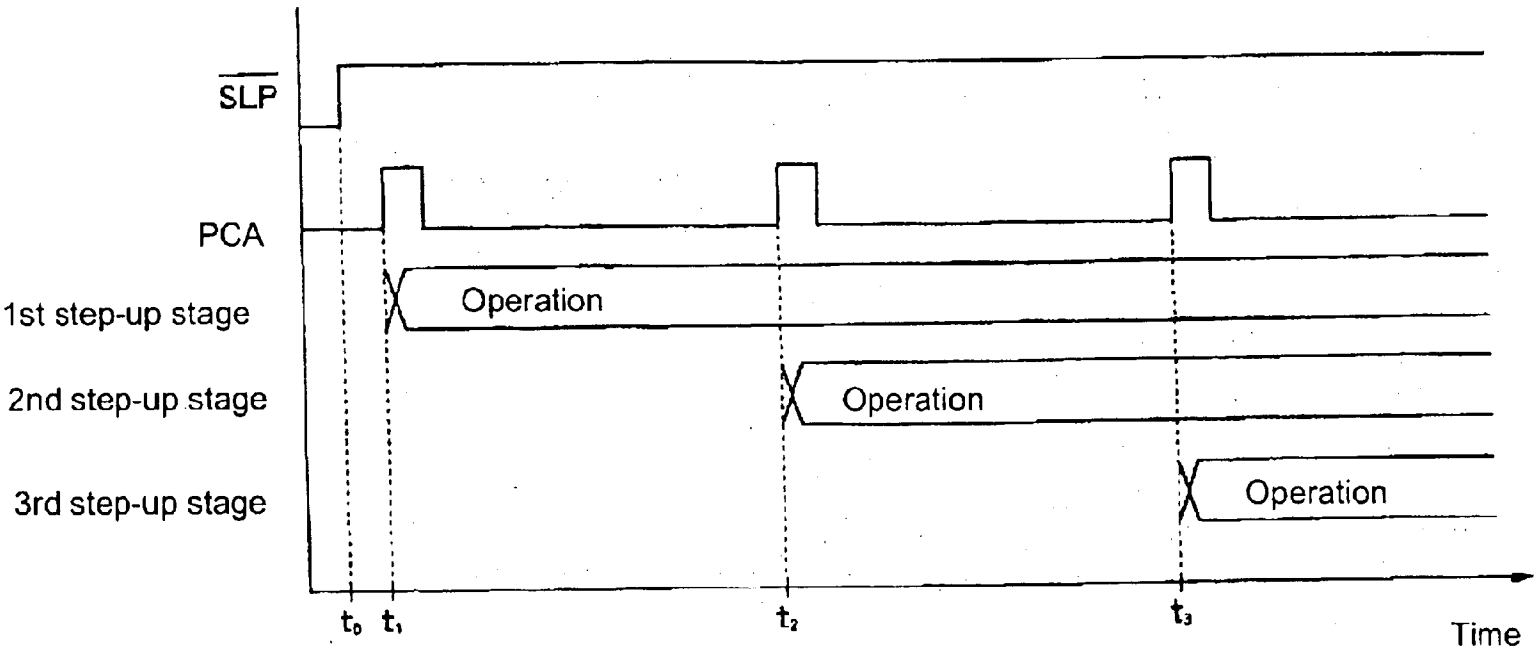
FIG. 4 shows a timing chart of operation timings of the step-up circuit in accordance with other embodiments of the present invention.

FIG. 4 shows a timing chart of operation timings of the step-up circuit in FIG. 3.

As indicated in FIG. 4, a sleep mode is released at time $t_0$, and an inverted sleep mode signal SLP bar becomes a high level. In association with this change, the supply of the power clock signal PCL and scanning start pulses PCA in a vertical direction is started. The step-up clock signal generation circuit 10 generates a step-up clock signal based on the power clock signal PCL, and the counter 30 counts the scanning start pulses PCA in a vertical direction.

When the output value of the counter 30 becomes a first value (for example, 1), the latch circuit 31 sets the enable signal at a high level to activate the first step-up stage 51. The first step-up stage 51 starts a step-up operation based on the step-up clock signal. At time $t_2$, when the output value of the counter 30 becomes a second value (for example, 2), the latch circuit 31 sets the enable signal at a high level to activate the second step-up stage 52, and the second step-up stage 52 starts a step-up operation based on the step-up clock signal. At time $t_3$, when the output value of the counter 30 becomes a third value (for example, 3), the latch circuit 31 sets the enable signal at a high level to activate the third step-up stage 53, and the third step-up stage 53 starts a step-up operation based on the step-up clock signal.

Thereafter, a sleep mode is set again, and when an inverted sleep mode signal SLP bar becomes a low level, the output value of the counter 30 and outputs of the latch circuit are reset. In the present embodiment, the counter 30 counts the scanning start pulses PCA in a vertical direction. However, it may count a power clock signal PCL.

Also, in the present embodiment, when the step-up circuit starts its operation, the timings to activate the multiple step-up stages 51–53 are shifted such that the step-up stages are operated successively stage by stage. As a result, a drop in the power supply voltage can be suppressed.

Figure 5:
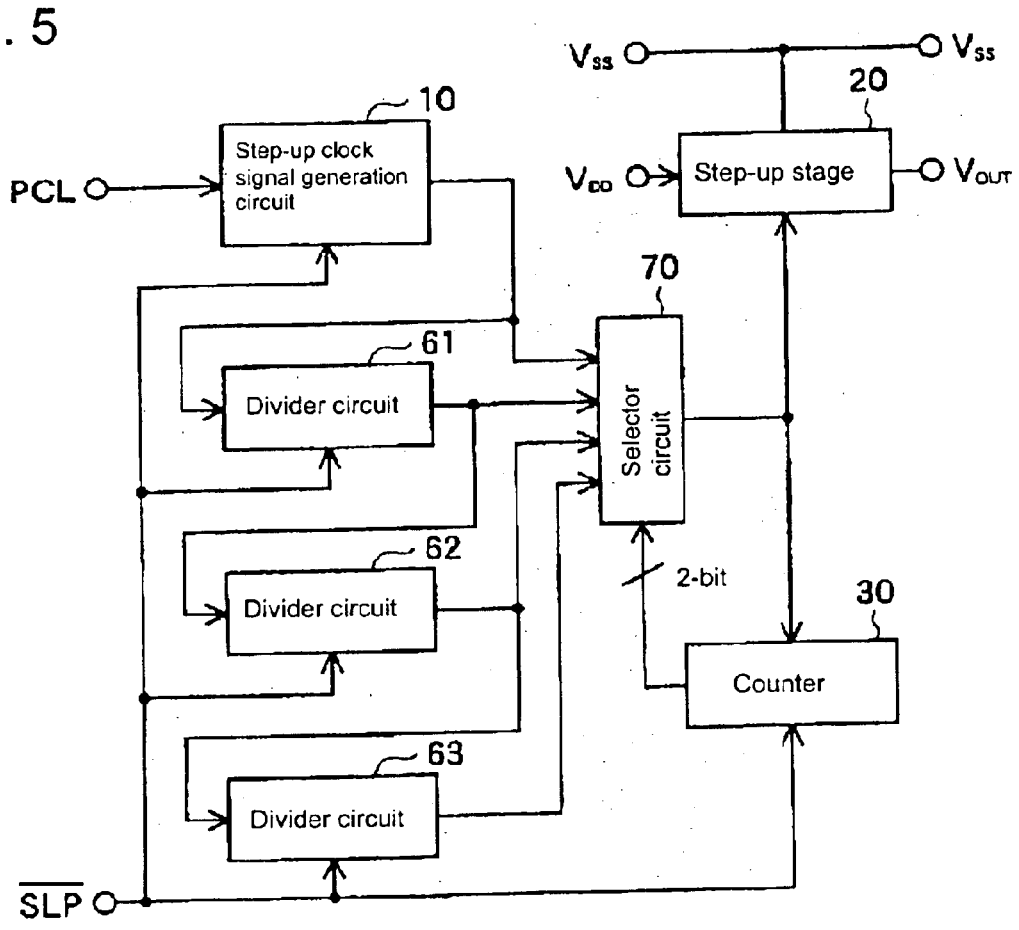
FIG. 5 shows a block diagram of a structure of a step-up circuit in accordance with still other embodiments of the present invention.

FIG. 5 shows a block diagram of a structure of the step-up circuit in accordance with another embodiment of the present invention. As. indicated in FIG. 5, the step-up circuit includes a step-up clock signal generation circuit 10 that generates a step-up clock signal based on a power clock signal PCL supplied, a plurality of frequency-divider circuits 61–63 that individually frequency-divide the step-up clock signal and output plural frequency-divided clock signals, and a selector circuit 70 that selects one of the clock signals among the step-up clock signal and the plural frequency-divided clock signals.

Further, the step-up circuit includes a counter 30 that counts the clock signal selected by the selector circuit 70, and at least one step-up stage 20 that steps up, based on the clock signal selected by the selector circuit 70, a voltage between a first power supply potential $V_{DD}$ and a second power supply potential $V_{SS}$ (which is a ground potential in the present embodiment) and outputs an output potential $V_{OUT}$. The step-up stage 20 may have a structure shown in FIG. 9, for example.

Each of the frequency-divider circuits 61–63 frequency-divides an inputted clock signal in half. As a result, the frequency-divider circuit 61 outputs a half frequency-divided clock signal having one half of the frequency of the step-up clock signal generated by the step-up clock signal generation circuit 10; the frequency-divider circuit 62 outputs a quarter frequency-divided clock signal having one quarter of the frequency of the step-up clock signal generated by the step-up clock signal generation circuit 10; and the frequency-divider circuit 63 outputs a one-eighth frequency-divided clock signal having one eighth of the frequency of the step-up clock signal generated by the step-up clock signal generation circuit 10.

The counter 30 counts the clock signal selected by the selector circuit 70, and outputs a two-bit output value according to the counted numbers (, which may be "00", "01", "10" or "11" in the binary system). The selector circuit 70 selects, based on the output value of the counter 30, one of the clock signals among the step-up clock signal generated by the step-up clock signal generation circuit 10 and the plural frequency-divided clock signals output by the plurality of frequency-divider circuits 61–63. When the value of the counter 30 becomes "11", the counting is stopped.

Figure 6:
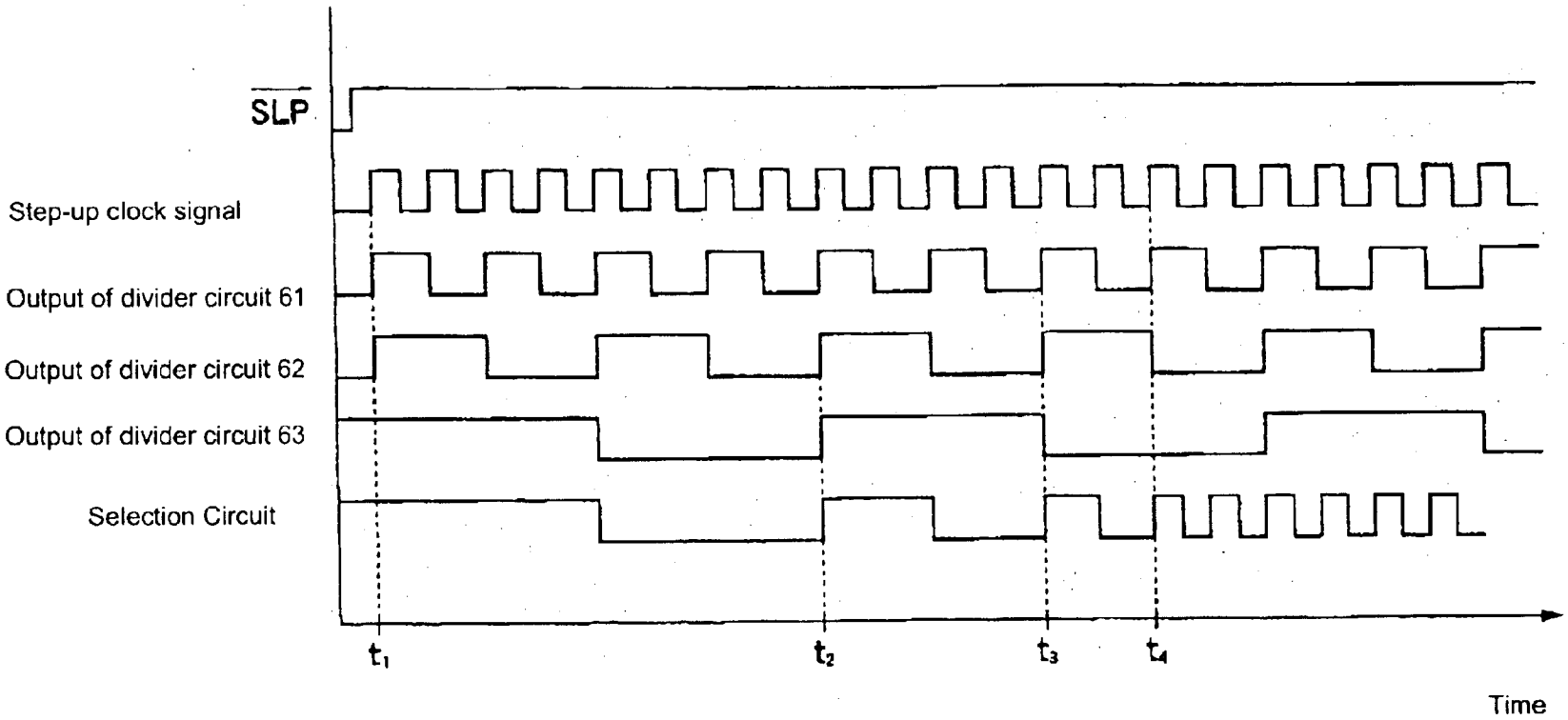
FIG. 6 shows a timing chart of operation timings of the step-up circuit in accordance with still other embodiments of the present invention.

Next, operations of the step-up circuit of the present embodiment will de described with reference to FIGS. 5 and 6. FIG. 6 shows a timing chart of operation timings of the step-up circuit in FIG. 5.

Initially, the step-up circuit is in a sleep mode, and an inverted sleep mode signal SLP bar is at a low level. By this, the output value of the counter 30 is reset to "00", and the output of the frequency-divider circuit 63 is set at a high level.

As indicated in FIG. 6, the sleep mode is released at time $t_1$, and the inverted sleep mode signal SLP bar becomes a high level. In association with this change, the power clock signal PCL is supplied. The step-up clock signal generation circuit 10 generates a step-up clock signal based on the power clock signal PCL, and the frequency-divider circuits 61–63 start outputting frequency-divided clock signals. In this state, the selector circuit 70 is selecting the one-eighth frequency-divided clock signal output from the frequency-divider circuit 63.

At time $t_2$, when the output value of the counter 30 becomes "01", the selection circuit 70 selects the one-fourth frequency-divided clock signal that is output from the frequency-divider circuit 62. Next, at time $t_3$, when the output value of the counter 30 becomes "10", the selection circuit 70 selects the one-half frequency-divided clock signal that is output from the frequency-divider circuit 61. Further, at time $t_4$, when the output value of the counter 30 becomes "11", the selection circuit 70 selects the step-up clock signal that is generated by the step-up clock signal generation circuit 10. By changing the counter, the timings $t_1$–$t_4$ can be changed.

In this manner, upon starting the operation of the step-up circuit, the frequency of the clock signal to be supplied to the step-up stage 20 is gradually changed from a value lower than a normal value closer to the normal value such that changes in the power supply voltage can be suppressed. In the present embodiment, since the power supply voltage $V_{SS}$ is a ground potential, a drop of the power supply voltage $V_{DD}$ can be suppressed.

Figure 7:
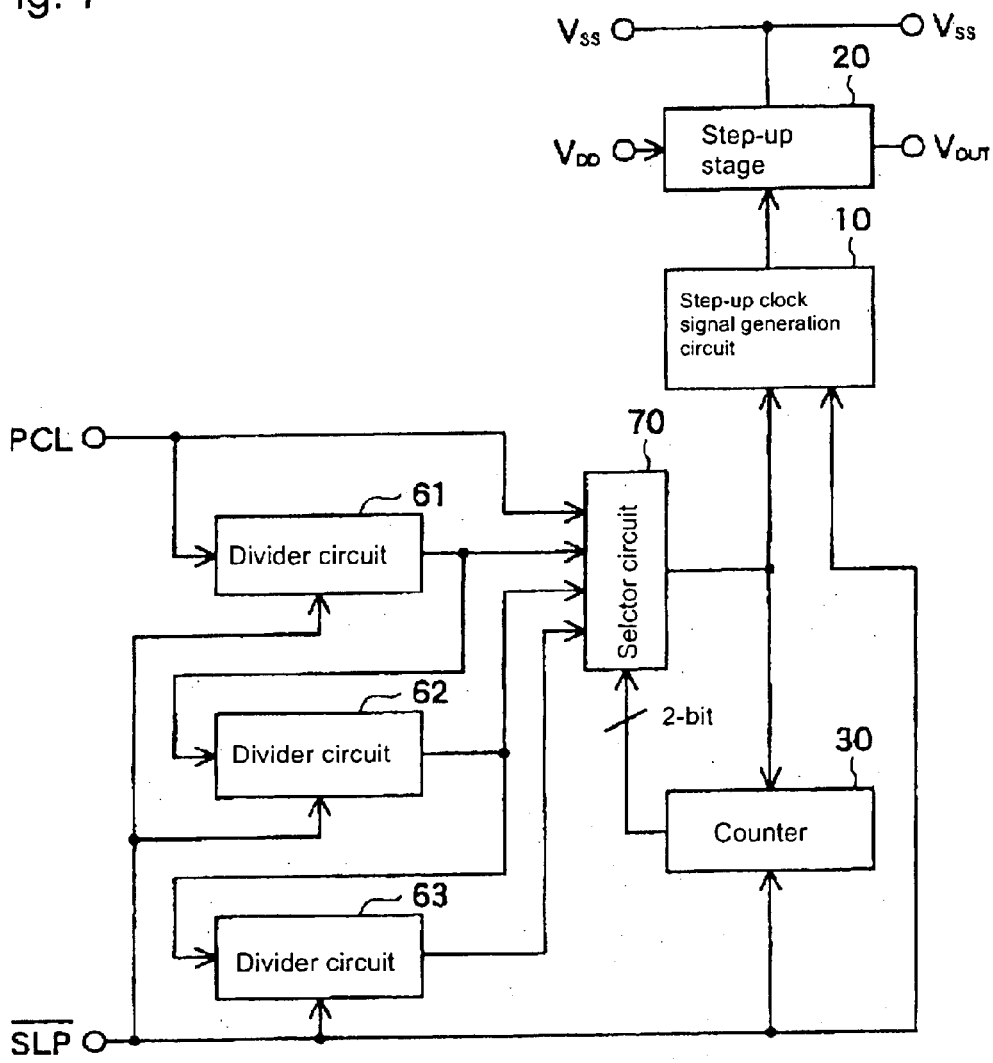
FIG. 7 shows a block diagram of a structure of a step-up circuit in accordance with further embodiments of the present invention.

FIG. 7 shows a block diagram of a structure of the step-up circuit in accordance with another embodiment of the present invention. In the present embodiment, a step-up clock signal generation circuit 10 is disposed in a succeeding stage of a selection circuit 70, and the other aspects are the same as those discussed with respect to FIG. 5.

A plurality of frequency-divider circuits 61–63 independently frequency-divide a power clock signal PCL supplied, and output a plurality of frequency-divided clock signals, respectively. A selector circuit 70 selects one of the clock signals among the power clock signal PCL and plural divided clock signals. The step-up clock signal generation circuit 10 generates a step-up clock signal based on the clock signal selected by the selector circuit 70. A step-up stage 20 steps up, based on the stepped up clock signal generated by the step-up clock signal generation circuit 10, a voltage between a first power supply potential $V_{DD}$ and a second power supply potential $V_{SS}$ and outputs an output potential $V_{OUT}$.

Figure 8:
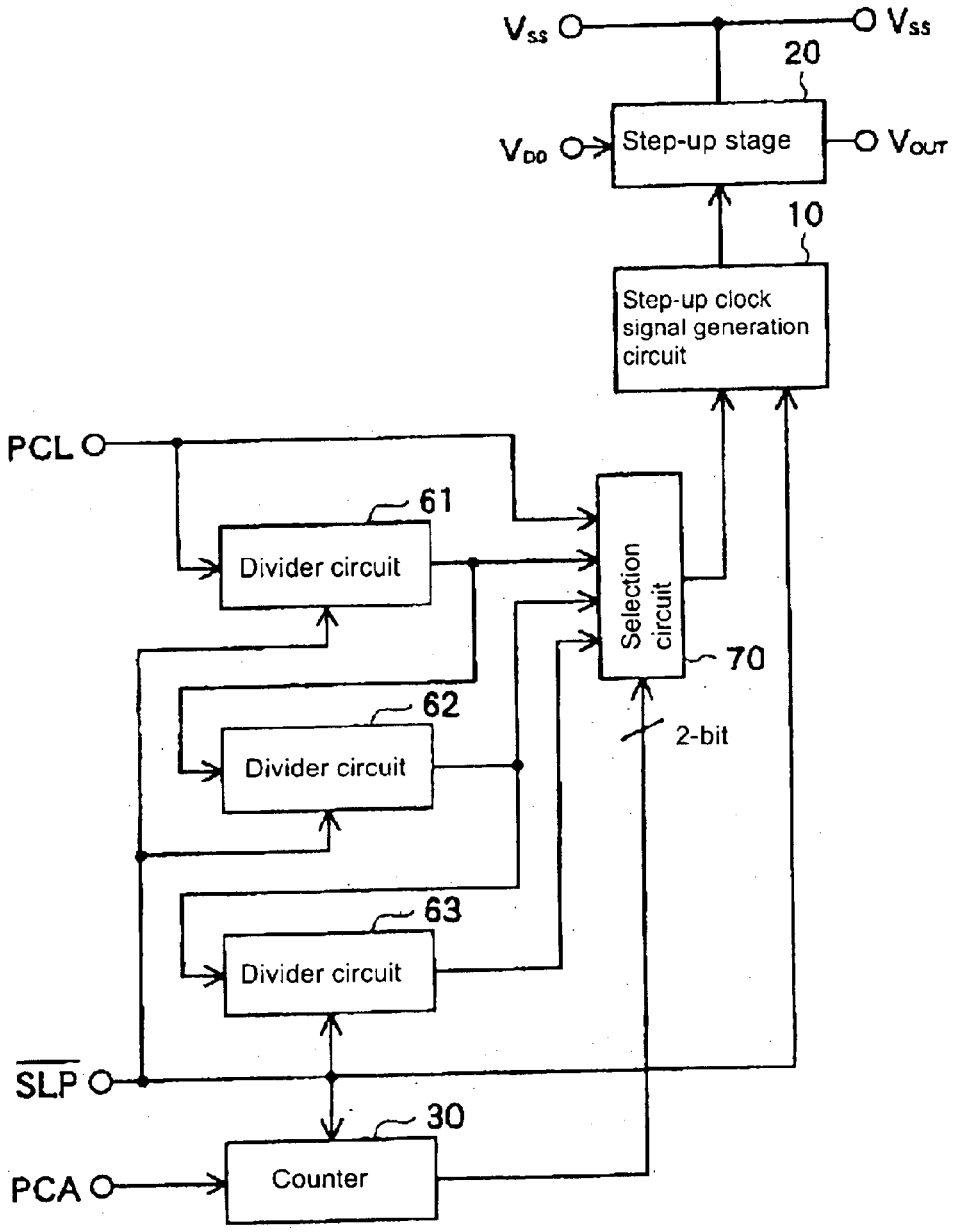
FIG. 8 shows a block diagram of a structure of a step-up circuit in accordance with still further embodiments of the present invention.

FIG. 8 shows a block diagram of a structure of the step-up circuit in accordance with another embodiment of the present invention. In the present embodiment, a counter 30 counts scanning start pulses in a vertical direction that are used for a liquid crystal display or the like. The other aspects are the same as those discussed with respect to FIG. 7.

Accordingly, changes in the power supply potential at the time of starting the operation of the step-up circuit can be reduced.

While aspects of the present invention have been described in terms of certain preferred embodiments, those of ordinary skill in the will appreciate that certain variations, extensions and modifications may be made without varying from the basic teachings of the present invention. As such, aspects of the present invention are not to be limited to the specific preferred embodiments described herein. Rather, the scope of the present invention is to be determined from the claims, which follow.

What is claimed is:

1. A step-up circuit, comprising:

a step-up clock signal generation device that generates a clock signal to be used for voltage step-up;

a plurality of step-up stages for successively stepping up a power supply voltage based on the clock signal; and a control device that controls, after starting an operation, the clock signal generated by the step-up clock signal generation device to be supplied to the plurality of step-up stages at different times, wherein the step-up clock signal generation device generates a clock signal to be used for voltage step-up based on a clock signal applied, and wherein the control device includes:

a counter that counts the clock signal applied to the step-up clock signal generation circuit, and a plurality of output control circuits that respectively supply, based on different output values of the counter, the clock signal generated by the step-up clock signal generation circuit to the plurality of step-up stages.

2. A step-up circuit, comprising:

a step-up clock signal generation device that generates a clock signal to be used for voltage step-up;

a plurality of step-up stages for successively stepping up a power supply voltage based on the clock signal; and a control device that controls, after starting an operation, the clock signal generated by the step-up clock signal generation device to be supplied to the plurality of step-up stages at different times, wherein the control device includes:

a counter that counts pulse signals applied, and a plurality of output control circuits that respectively supply, based on different output values of the counter, the clock signal generated by the step-up clock signal generation circuit to the plurality of step-up stages.

3. A step-up circuit, comprising: means for generating a step-up clock signal to be used for voltage step-up; means for successively stepping up a power supply voltage based on the clock signal; and means for controlling, after starting an operation, the clock signal generated by the means for generating a step-up clock signal to be supplied to the means for successively stepping up at different times, wherein the means for generating a step-up clock signal generates a clock signal to be used for voltage step-up based on a clock signal applied, and wherein the means for controlling includes:

means for counting the clock signal applied to the step-up clock signal generation circuit, and a plurality of output control circuits that respectively supply, based on different output values of the means for counting, the clock signal generated by the step-up clock signal generation circuit to the means.

4. A step-up circuit, comprising:

means for generating a step-up clock signal to be used for voltage step-up;

means for successively stepping up a power supply voltage based on the clock signal; and means for controlling, after starting an operation, the clock signal generated by the means for generating a step-up clock signal to be supplied to the means for successively stepping up at different times, wherein the means for controlling includes:

means for counting pulse signals applied, and a plurality of output control circuits that respectively supply, based on different output values of the means for counting, the clock signal generated by the step-up clock signal generation circuit to the means for successively stepping up.

5. A method of operating a step-up circuit, comprising:

generating a step-up clock signal to be used for voltage step-up;

successively stepping up a power supply voltage based on the clock signal; and controlling, after starting an operation, the clock signal to be supplied at different times, wherein the generating a step-up clock signal generates a clock signal to be used for voltage step-up based on a clock signal applied, and wherein the controlling includes:

counting the clock signal, and supplying, based on different output values of the counting, the clock signal.

6. A method of operating a step-up circuit, comprising:

generating a step-up clock signal to be used for voltage step-up;

successively stepping up a power supply voltage based on the clock signal; and controlling, after starting an operation, the clock signal to be supplied at different times, wherein the controlling includes:

counting pulse signals applied, and supplying, based on different output values of the counting, the clock signal.

* * * * *